US005334437A

United States Patent [19]

Zafiroglu

[11] Patent Number: 5,334,437

[45] Date of Patent: Aug. 2, 1994

[54] SPUNLACED FABRIC COMPRISING A NONWOVEN BATT HYDRAULICALLY ENTANGLED WITH A WARP-LIKE ARRAY OF COMPOSITE ELASTIC YARNS

[75] Inventor: Dimitri P. Zafiroglu, Wilmington, Del.

[73] Assignee: E. I. Du Pont de Nemours and Company, Wilmington, Del.

[21] Appl. No.: 946,861

[22] Filed: Sep. 23, 1992

[51] Int. Cl.[5] ..... B32B 5/06; D04H 1/74; D02G 3/32

[52] U.S. Cl. ..... 428/219; 428/284; 428/286; 428/288; 428/294; 428/299; 428/377

[58] Field of Search ..... 428/377, 294, 288, 229, 428/230, 231, 299, 286, 284, 219

[56] References Cited

U.S. PATENT DOCUMENTS

| | | | |
|---|---|---|---|
| 3,013,379 | 12/1961 | Breen | 57/157 |
| 3,377,231 | 4/1968 | Newman | 161/80 |
| 3,485,706 | 12/1969 | Evans | 161/72 |
| 3,537,945 | 11/1970 | Summers | 161/57 |
| 3,940,917 | 3/1976 | Strachan | 57/152 |
| 4,552,795 | 11/1985 | Hansen et al. | 428/110 |
| 4,863,776 | 9/1989 | Steinlieb | 428/294 |

FOREIGN PATENT DOCUMENTS 900884 2/1990 South Africa .

*Primary Examiner*—James D. Withers

[57] ABSTRACT

One or more nonwoven fibrous layers and an array of elastic combination yarns, preferably comprising spandex combined with conventional hard textile yarn, are formed into an elastically stretchable fabric by hydraulic entanglement.

5 Claims, No Drawings

SPUNLACED FABRIC COMPRISING A NONWOVEN BATT HYDRAULICALLY ENTANGLED WITH A WARP-LIKE ARRAY OF COMPOSITE ELASTIC YARNS

BACKGROUND OF THE INVENTION

1. Field of the Invention

The present invention relates to a spunlaced fabric comprising a nonwoven fibrous layer hydraulically entangled with an array of elastic yarns. More particularly, the invention concerns such a fabric wherein the elastic yarns are elastic combination yarns. The fabrics are suited for use in protective clothing, bandages, parts of diapers, and the like.

2. Description of the Prior Art

Spunlaced fabrics are known. Such fabrics are prepared by conventional hydraulic entanglement techniques and comprise a nonwoven fibrous layer and an array of elastic are known. For example, Evans, U.S. Pat. No. 3,485,706, discloses such a spunlaced fabric wherein at least one layer of staple fibers is hydraulically entangled with an array of continuous filament yarns. The patent specifically discloses in Example 56, Sample e, a spunlaced fabric made of two layers of polyester staple fibers and an array of separate, parallel, 70-denier bare spandex yarns that were stretched about 200% and held at that extension during the hydraulic entanglement treatment. Sample "e" was described as "a bulky, puckered fabric with high elasticity in the warp direction". However, the present inventor found that such hydraulically entangled nonwoven fabrics, made with an array of bare spandex yarns, become damaged by repeated stretching. Such stretching causes the bare elastic yarns to become loose and retract into the fabric, there causing the fabric to lose its elasticity.

Elastic combination yarns are known. Such yarns usually comprise at least two components, an elastic yarn component and a second yarn component of relatively inelastic (or "hard fiber") strands. Such known yarns include wrapped yarns, covered yarns, plied yarns, false twisted yarns, air-jet interlaced yarns, air-jet entangled yarns and the like. However, such yarns are not known to have been hydraulically entangled with a fibrous layer to form spunlaced fabric.

SUMMARY OF THE INVENTION

The present invention provides an improved elastic spunlaced fabric of the type that comprises a nonwoven fibrous layer hydraulically entangled with an array of elastic yarn. In accordance with the improvement of the present invention, the elastic yarn array is formed with combination yarn which comprises a component of elastic yarn and a second component of hard fibers. Preferably, the elastic component of the combination yarn is of spandex and the combination yarn has an elongation at break of at least 100% and the elastic combination yarn amounts to 3 to 50 percent of the total weight of the spunlaced fabric.

DETAILED DESCRIPTION OF PREFERRED EMBODIMENTS

The invention will now be described in greater detail with regard to preferred embodiments. The descriptions are intended for illustrative purposes and are not intended to limit the scope of the invention. The scope is defined by the appended claims.

In accordance with the present invention, one or more nonwoven fibrous layers and an array of elastic combination yarns are formed into an elastically stretchable fabric by hydraulic entanglement.

A wide range of starting fibrous layers are suitable for use in the present invention. For example, batts of carded fibers, air-laid fiber batts, sheets of substantially unbonded fibers or continuous filaments of textile denier, sheets of woodpulp, continuous filament webs and the like. The fibers can be natural fibers or fibers of synthetic organic polymer. Typically, a suitable total weight of the fibrous layers is in the range the range of 0.5 to 5 oz/yd$^2$ (17 to 170 g/m$^2$).

The starting fibrous layers are usually "substantially nonbonded". As used herein, this term means that the fibers generally are not bonded to each other, as for example, by chemical or thermal action. However, a small amount of bonding is intended to be included in the term "substantially nonbonded". As long as the amount of bonding does not prevent the fibers of the layer from entangling with the composite elastic yarns during the fabrication of the final fabric by hydraulic entanglement, the fibers are considered to be substantially nonbonded.

Suitable arrays of combination yarns include warp-like arrays, cross-warps, and the like. The fraction of the total weight of the elastic fabric that the arrays of combination yarns amount to is typically in the range of 3 to 50%, preferably 25 to 40%, depending on the desired end-use for the fabric.

As used herein, the terms "elastic combination yarn" refers to a combination yarn which has a first component of elastic filaments that are combined with a second component of non-elastomeric (i.e., "hard") textile fibers or filaments. The elastic-filament content of the combination yarn can vary over a wide range. The elastic-filament content can amount to as much as 60% percent of the total weight of the combination yarn. More typically, the elastic filament content is in the range of 2 to 20% of the total weight of the yarn and a content of 3 to 8% generally is preferred for reasons of cost. Usually, the combination yarn is a bulky yarn that is capable of a considerable elastic stretch and recovery. Typical elastic combination yarns for use in the present invention have a recoverable elongation in the range of 50% to 250%, or even higher. Elastic filaments for the first component of the combination yarns are of spandex, elastomers, rubber or the like. Spandex is preferred. As used herein, the term "spandex" has its conventional meaning; namely, a manufactured fiber or filament in which the fiber-forming substance is a long chain synthetic polymer comprised of at least 85% of a segmented polyurethane. Among the yarns included in the term "combination yarns" are yarns of elastic filaments combined with yarns of staple textile fibers or of textile filaments by known techniques such as air-jet entangling, air-jet intermingling, covering, plying and the like.

Conventional techniques of hydraulic entanglement are suited for combining the elastic combination yarn array with the nonwoven fibrous layers to form the elastic nonwoven fabrics of the invention. Usually, bulky combination yarns are preferred. Such bulkiness typically is provided by the non-elastomeric component of the combination yarn. The bulkiness is manifest as loops, crimps, loose portions, loose ends, and the like. In the hydraulic entanglement operation, the bulky structure is readily entangled with the fibrous layer to firmly incorporate the elastic yarns with the fibrous layer in the fabric. In hydraulically entangling the elastic combination yarns with the fibrous layer in accordance with the invention, it is preferred to place the bulky, elastic combination yarns in contact with the fibrous layer while the yarns are under tension, but not stretched to their maximum extent. Preferably the yarns can still stretch another 25 to 75% (i.e., have a residual stretch in the range of 25 to 75%). When the hydraulically entangled fabric is removed from the entanglement operation, the tension in the yarns is released and the fabric contracts and becomes more bulky.

The hydraulically entangled spunlaced nonwoven fabric of the invention is useful in the as-made condition (i.e., as greige fabric). Generally, fabrics of the invention have an elastic stretchability in the direction of the elastic combination yarns in the range of 25% to 250% or higher, 100 to 200% usually being preferred. The fabric usually has a total unit weight in the range of 0.5 to 5 oz/yd$^2$ (17 to 170 g/m$^2$); 1 to 3 oz/yd$^2$ (34 to 102 g/m$^2$) is preferred. The fabric is strong, usually having a grab tensile strength in the direction of the combination yarns in the range of 10 to 50 lb/in of width per oz/yd$^2$ (5.2 to 25.8 deciNewton/cm per g/m$^2$) and a tongue tear perpendicular to the combination yarns in the range of 0.4 to 1.5 lb per oz/yd$^2$ (0.5 to 2 dN per g/m$^2$). Preferred ranges for the fabric grab tensile strength and tongue tear are respectively in the ranges of 15 to 40 lb/in per oz/yd$^2$ (7.7 to 20.6 dN/cm per g/m$^2$) and 0.5 to 1.3 lb per oz/yd$^2$ (0.7 to 1.7 dN per g/m$^2$).

The fabric can be subjected to a wide variety of optional, conventional fabric-finishing treatments. The particular finishing treatment selected depends on the properties and requirements of the fabric in use. Among such treatments are heat setting, tentering, shrinking, molding, dyeing and the like.

Test Procedures

In the preceding description and in the Examples below, various properties and characteristics are reported for the elastic nonwoven fabrics of the invention and the components used to produce them. These properties and characteristics were measured by the following procedures.

Unit weight of a fabric or of a fibrous layer was measured in accordance with ASTM Method D-3776-79. The amount of combination yarn per unit weight of fabric was determined from the yarn denier and the length of yarn used during fabrication of a unit of fabric area. The weight of yarn per unit area divided by the total weight per unit area of fabric is the weight fraction of combination yarn in the fabric. The weight of the yarn array also could be determined from the total weight of a given area of fabric and the weight of all yarn carefully removed from that area.

Tear resistance (i.e., tongue tear) was measured by ASTM Method D 226164T/C-14-20. Brab tensile strength was measured in general accordance with ASTM Method D 1117-80. An Instron tensile testing machine, a 4-inch (10.2-cm) wide by 6-inch (15.2-cm) long sample, a gauge length of 3 inches (7.6 cm), clamp jaws of 1-inch (2.5-cm) width, and an elongation rate of 12 inches (30.5 cm) per minute were used. Measurements are reported in the LD (longitudinal or "machine" direction), i.e., in the direction of the combination yarns, and/or in the TD (transverse or "cross-machine" direction), i.e., perpendicular to the direction of the combination yarns. Tongue tear strength is reported in pounds per inch of fabric width per ounce per square yard of fabric weight or in deciNewtons/cm per g/m$^2$, and grab tensile strength is reported in pounds per ounce per square yard of fabric weight or in deciNewtons per g/m$^2$.

The elastic stretchability, in percent, was determined by the following procedure. A 2-inch-long (5.08-cm) gauge length of was marked on a flat, 2-inch-wide strip of fabric sample. The sample was suspended vertically between two 3-inch (7.62-cm) wide clamps, each grasping one end of the marked gauge length. A weight was gently suspended from the lower clamp for one minute; the total load on the sample was 10 pounds (4.54 kg). After the lower clamp and weight were removed and the sample allowed to relax on a flat surface, the marked gauge length was re-measured. The elastic stretchability in percent was then calculated by the formula $$\% \text{ elastic stretch} = 100\,(L_s - L_r)/L_r,$$

wherein $L_s$ is the stretched length with the weight suspended and $L_r$ is the relaxed length after the weight had been removed.

To determine whether a fabric possessed sustainable properties of elastic stretch and recovery, the fabric was subjected to a cyclic stretching test. In this test, a 2-inch-wide (5.08-cm-wide) sample of fabric having a 2-inch gauge length was suspended between clamps as in the elastic stretch test of the preceding paragraph, except that the clamps were each 1-inch (2.54-cm) wide, so that a ½-inch (1.27-cm) width of not-clamped fabric sample extended beyond each edge of each clamp. After each removal of the 10-lb (4.54-Kg) weight the unclamped portions of the sample were inspected for elastic yarns that became loose and retracted into the fabric. To pass the test on any load-on/load-off cycle, no such damage must have been evident. Also, to pass repeated cycles, the elastic stretch of the fabric must remain substantially unchanged (i.e., it must remain constant within 10 percentage points).

EXAMPLES

The following examples illustrate the preparation of elastic spunlaced nonwoven fabrics having arrays of elastic combination yarns in accordance with the invention and compare the fabrics with similar fabrics made with arrays of bare spandex yarns which are outside of the invention. The examples show that fabrics made with bare spandex seldom survived more than one stretch cycle before the bare spandex yarns become loose in the fabric and the fabric is damaged. In contrast, sample fabrics of the invention made with combination yarns containing a spandex component exhibit no loosening of the elastic combination yarns and no significant reduction in the integrity or elasticity of the fabric, in at least 10 repeated weight-on/weight-off stretch cycles. In the examples, samples of the invention are designated with Arabic numerals and comparison samples are designated with upper-case letters.

The hydraulic entanglement equipment that was used to produce the elastic nonwoven fabrics of the examples was substantially as described in Summers, U.S. Pat. No. 3,537,945, column 4, lines 5–45 and FIG. 1, the disclosure of which is hereby incorporated by reference. Summers also discloses in column 4, line 54 through column 5, line 8, and FIG. 2, equipment suited for performing the hydraulic entanglement in largescale continuous production. Further information on the operation of such equipment is disclosed by Evans, U.S. Pat. No. 3,485,706. Details are given in each example of the particular manner in which the equipment was operated for making the samples of the examples.

For the Examples below, the following yarns, combination yarns and webs were employed to prepare the samples of the invention and the comparison samples.

Y-1. A combination yarn of 140-denier (154-dtex) Lycra® wrapped with 40-den (44-dtex) textured nylon. Lycra® is a spandex yarn manufactured by E. I. du Pont de Nemours & Co.; the combination yarn was manufactured by Macfield Texturing Inc. of Madison, N.C.

Y-c. A bare 140-denier (154-dtex) Lycra®, i.e., same as Y-1 but with no covering.

W-1. A 1-oz/yd$^2$ (33.9-g/m$^2$) nonbonded web of 1.5-den (1.7-dtex) polypropylene filaments, manufactured by Polybond, Inc.

W-2. A 1-oz/yd$^2$ (33.9-g/m$^2$) nonbonded web of 1.35-den (1.5-dtex), $\frac{7}{8}$-inch (2.2-cm) long polyester staple fibers (Type 106 Dacron®, manufactured by E. I. du Pont de Nemours & Co.).

W-3. A 1.3-oz/yd$^2$ (44-g/m$^2$) nonbonded sheet of Western Red Cedar Woodpulp.

EXAMPLE I

This example illustrates the preparation of elastic nonwoven fabrics of the invention by hydraulic entanglement of a unidirectional warp-like array of elastic combination yarns of nylon-covered spandex (Y-1) between an upper and a lower fibrous web. The samples of the invention (Samples 1, 2 and 3) are compared with similar samples (Sample A) prepared with bare spandex yarn (Y-c), rather than with covered spandex yarn. The comparison clearly demonstrates the superiority of the samples of the invention in their ability to survive numerous elastic stretches. The comparison samples made with bare spandex were unable to successfully survive one load-unload cycle of the pass-fail test; many of the bare elastic filaments became loose and retracted into the fabric as a result of one cycle. In contrast, the combination yarns of the elastic fabrics of the invention showed no signs of such failure even after ten or more load-unload cycles. Further details of the fabrication and resultant fabrics are summarized in the following paragraphs and in Table I below.

Warp-like arrays of elastic yarns for the sample fabrics of this example were prepared by winding the desired yarn on a 16-inch (40.6-cm) long by 12-inch (30.5-cm) wide frame with a spacing of 12 yarns per inch (4.7/cm). In forming the arrays, for each half-turn of yarn on the frame (a) the yarn was held straight, (b) stretched to 26 inches (65 cm) and (c) allowed to retract to 16 inches (41 cm). This winding procedure, with its stretching and partial retraction of the wound yarns resulted in wound yarns being under tension but having a residual stretch of 62.5%. Then, the ends of the yarns were taped to the frame and subsequently cut to form a single layer of parallel yarns. For Samples 1, 2 and 3 of the invention, combination yarn Y-1 was used to form the array; for Comparison Sample A, bare spandex yarn Y-c was used. Each parallel array of yarns was placed between an upper and a lower fibrous layer of the type indicated in Table I. The thusly assembled yarns and layers were placed on a 13-mesh metal screen that had a 20% open area and then subjected to hydraulic entanglement by being passed at a speed of 10 yards per minute (9.14 meters/min) perpendicular to a line of columnar jets of water issuing from 0.005-inch (0.125-mm) diameter orifices. The orifices were evenly spaced at 40/inch (15.7/cm), located 1 inch (2.54 cm) above the surface of the screen and operated at a supply pressure of 200 psig (1,380 kiloPascals) for a first pass and then at 1,500 psig (10,300 kPa) for another three passes.

TABLE I

| | Of Invention | | | Comparison |
|---|---|---|---|---|
| Samples | 1 | 2 | 3 | A |
| Fibrous layers | | | | |
| Top | W-2 | W-2 | W-3 | W-2 |
| Bottom | W-1 | W-2 | W-2 | W-2 |
| Warp yarns | Y-1 | Y-1 | Y-1 | Y-c |
| Fabric | | | | |
| Wt. % Yarn | 6.5 | 6.5 | 5.7 | 8.3 |
| Unit weight | | | | |
| oz/yd$^2$ | 3.2 | 3.4 | 4.1 | 3.1 |
| (g/m$^2$) | 108 | 115 | 139 | 105 |
| Grab Strength, LD/TD | | | | |
| (lb/in)/(oz/yd$^2$) | 22/9.4 | 16/7.9 | 13/5.5 | 11/6.3 |
| (dn/cm)/(g/m$^2$) | 11/4.9 | 8.1/4.1 | 6.6/2.8 | 5.5/3.3 |
| elastic stretch, %* | 163 | 183 | 118 | 45 |
| load/unload test | pass | pass | pass | fail |

*Elastic stretch in the direction of the elastic yarns was measured for samples of the invention after a first load/unload cycle and for the comparison sample on the first load/unload cycle.

The results of the above-summarized tests showed that not only were the fabrics of the invention far superior in their ability to survive the load/unload test (at least 10 cycles versus no more than one for the comparison sample), but the elastic fabric samples made with combination yarns in accordance with the invention also were stronger, more tear resistant and of higher elastic stretch than the comparison sample. It was also found that once the comparison sample had been subjected to a load-unload cycle, additional cycles would cause the elastic stretch of the fabric to rapidly be reduced to substantially zero.

EXAMPLE II

This example illustrates the preparation of an elastic nonwoven fabric of the invention (Sample 4) by hydraulic entanglement of an array of cross-laid warps of composite elastic yarn of nylon-covered spandex (Y-1) between two fibrous layers of polyester staple fiber web (W-2). Sample 4 of the invention is compared with a similar sample (Sample B) prepared with cross-laid warps of bare spandex (Y-c). As in Example I, the comparison clearly demonstrates the superiority of the sample of the invention over the comparison sample. Comparison Sample B, made with bare spandex, was unable to successfully survive one load-unload cycle of the pass-fail test before many of the bare elastic filaments became loose and retracted into the fabric. In contrast, the combination yarns of the elastic fabric of the invention showed no signs of such failure even after twenty load/unload cycles.

To prepare the fabrics of this example, the procedures for assembling and hydraulically entangling Sample 2 and Comparison A of Example I were repeated except that the single warp of parallel yarns was replaced with two such warps positioned perpendicular to each other. Further details of the fabrication and resultant fabrics are summarized in Table II below.

TABLE II

| Samples | Of Invention 4 | Comparison B |
|---|---|---|
| Fibrous layers | | |
| Top | W-2 | W-2 |
| Bottom | W-2 | W-2 |
| Yarns of cross-warp | Y-1 | Y-c |
| Fabric | | |
| Wt. % Yarn | 12.2 | nm** |
| Unit weight | | |
| $oz/yd^2$ | 3.9 | 3.9 |
| $(g/m^2)$ | 132 | 132 |
| Grab Strength, LD/TD | | |
| $(lb/in)/(oz/yd^2)$ | 18/16 | 15/13 |
| $(dN/cm)/(g/m^2)$ | 9.4/8.4 | 7.7/6.7 |
| Tear Strength, LD/TD | | |
| $Lb/(oz/yd^2)$ | 1.0/1.1 | 0.33/0.28 |
| $dN/(g/m^2)$ | 1.3/1.4 | 0.40/0.37 |
| % Elastic Stretch, LD/TD | 83/79 | 20/23 |
| Load/unload test | pass | fail |

**nm = no measurement mode

As in Example I, the results summarized in Table II, again demonstrate the superiority of the fabric of the invention over the comparison fabrics. Sample 4 made with a cross-warp of elastic combination yarns in accordance with the invention, were stronger, more elastic and very much more stable than Comparison Sample B which was made with a cross-warp of elastic yarn of bare spandex. Sample 4 successfully withstood 20 cycles of load/unload testing before the test was stopped, while Comparison Sample B exhibited retracting elastic yarns and failure after the first cycle.

I claim:

1. An improved spunlaced fabric that comprises a nonwoven fibrous layer hydraulically entangled with an array of elastic yarn, wherein the improvement comprises for greater resistance to damage from repetitive stretching, the elastic yarn array is formed with a combination yarn comprising a first component of elastic filaments, the first component amounting to no more than 60% of the total weight of the combination yarn, and a second component of non-elastomeric staple fibers or filaments of textile decitex, the yarns of said elastic yarn array being substantially free of over-and-under intercrossing relationships.

2. A spunlaced fabric in accordance with claim 1, wherein the first component of the combination yarn is of spandex and the combination yarn has an elongation at break of at least 100% and amounts to in the range of 3 to 50% of the total weight of the spunlaced fabric and the nonwoven fibrous layer amounts to 97 to 50% of the total weight of the spunlaced fabric.

3. An elastic spunlaced fabric in accordance with claim 2, wherein the spandex amounts to in the range of 2 to 20% of the total weight of the combination yarn, the spunlaced fabric has a unit weight in the range of 17 to 170 $g/m^2$, an elastic stretchability in the range of 25 to 250%, a grab tensile strength in a direction of the combination yarns in the range of 5.2 to 25.8 deciNewtons/cm of width per $g/m^2$, and a tongue tear in a direction perpendicular to the combination yarns in the range of 0.5 to 2 deciNewtons/$g/m^2$.

4. A spunlaced fabric in accordance with claim 1 having a unit weight in the range of 17 to 170 $g/m^2$.

5. A spunlaced fabric in accordance with claim 2 having a unit weight in the range of 17 to 170 $g/m^2$.

* * * * *